US006938970B2

(12) United States Patent
Van den Bergen

(10) Patent No.: US 6,938,970 B2
(45) Date of Patent: Sep. 6, 2005

(54) PRINTING METHODS AND APPARATUS FOR MULTI-PASS PRINTING

(75) Inventor: Patrick Van den Bergen, Hove (BE)

(73) Assignee: Agfa Gevaert, Mortsel (BE)

( * ) Notice: Subject to any disclaimer, the term of this patent is extended or adjusted under 35 U.S.C. 154(b) by 55 days.

(21) Appl. No.: 10/621,707

(22) Filed: Jul. 17, 2003

(65) Prior Publication Data

US 2004/0021732 A1 Feb. 5, 2004

Related U.S. Application Data

(60) Provisional application No. 60/403,287, filed on Aug. 14, 2002.

(30) Foreign Application Priority Data

Jul. 19, 2002 (EP) ..... 02102049

(51) Int. Cl.[7] ..... B41J 29/38
(52) U.S. Cl. ..... 347/13; 347/41
(58) Field of Search ..... 347/13, 41, 42, 347/104, 182

(56) References Cited

U.S. PATENT DOCUMENTS 4,208,666 A * 6/1980 Paranjpe ..... 347/104
6,293,651 B1 * 9/2001 Sawano ..... 347/40
2003/0234851 A1 * 12/2003 Booth et al. ..... 347/104

FOREIGN PATENT DOCUMENTS

EP 0 644 142 A1 3/1995
EP 02 10 2049 12/2002
JP 62215431 9/1987

OTHER PUBLICATIONS

G.L. Douglas, "Multi–Pass Printing with Automatic Paper Feeding", IBM Technical Disclosure Bulletin, vol. 27, No. 7A, Dec. 1984, pp. 3909–3910.

* cited by examiner

*Primary Examiner*—Lamson Nguyen
*Assistant Examiner*—Blaise Mouttet
(74) *Attorney, Agent, or Firm*—John A. Merecki; Robert A. Sabourin

(57) ABSTRACT

A multipass printer and printing method is described for printing an image on a sheet printing medium using a page wide printing head. A transporting device provides relative movement between the sheet printing media and a first print head. A series of sheet printing media are presented to the first print head for printing in sequence. The first print head prints a first sub-image of at least one set of monochromatic mutually interstitially printed sub-images of a first image onto a first sheet of printing medium of the series in one pass. A sub-image of an image is printed in succession on each remaining one of the series of sheet printing media followed by printing a further sub-image of the at least one set of monochromatic mutually interstitially printed sub-images of the first image onto the first sheet printing medium.

9 Claims, 5 Drawing Sheets

PRINTING METHODS AND APPARATUS FOR MULTI-PASS PRINTING

The application claims the benefit of U.S. Provisional Patent Application No. 60/403287 filed Aug. 14, 2002.

The present invention relates to methods and apparatus for multi-pass printing, such as ink jet or thermal transfer printing, especially non-contact printing.

TECHNICAL BACKGROUND

Printing is one of the most popular ways of conveying information to members of the general public. Digital printing using dot matrix printers allows rapid printing of text and graphics stored on computing devices such as personal computers. These printing methods allow rapid conversion of ideas and concepts to printed product at an economic price without time consuming and specialised production of intermediate printing plates such as lithographic plates. The development of digital printing methods has made printing an economic reality for the average person even in the home environment.

Conventional methods of dot matrix printing often involve the use of a printing head, e.g. an ink jet printing head, with a plurality of marking elements, e.g. ink jet nozzles. The marking elements transfer a marking material, e.g. ink or resin, from the printing head to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme, (e.g. CMYK plus one or more additional spot or specialised colours). To print a printing medium such as paper or plastic, the marking elements are used subjected to electric firing pulses and are "fired" in a specific order while the printing medium is moved relative to the printing head. Each time a marking element is fired, marking material, e.g. ink, is transferred to the printing medium by a method depending on the printing technology used. Typically, in one form of printer, the print head is held stationary and extends in a first direction across the complete width of the printing medium. The printing medium is moved relative to the print head in a second direction perpendicular or substantially perpendicular to the first direction to produce a series of so-called raster lines which extend in the first direction. A raster line comprises a series of dots delivered onto the printing medium by the marking elements of the printing head. It is preferred if the relative movement between the printing head and the printing medium is smooth and continuous but the printing medium may be moved intermittently in the second direction. An encoder linked to the means for moving the printing medium may provide pulses which can be used to synchronise the print head operation with the movement of the printing medium. The above is often described as "page-wide" printing using a page-wide print head.

The combination of printing raster lines and moving the printing medium relative to the printing head results in a series of parallel raster lines which are usually closely spaced. Seen from a distance, the human eye perceives a complete image and does not resolve the image into individual dots provided these dots are close enough together. Closely spaced dots of different colours are not distinguishable individually but give the impression of colours determined by the amount or intensity of the three colours cyan, magenta and yellow which have been applied.

In order to improve the veracity of printing, e.g. of a straight line, it is preferred if the distance between dots of the dot matrix is small, that is the printing has a high resolution. Although it cannot be said that high resolution always means good printing, it is true that a minimum resolution is necessary for high quality printing. A small dot spacing in the slow scan direction means a small distance between marker elements on the head, whereas regularly spaced dots at a small distance in the fast scan direction places constraints on the quality of the drives used to move the printing head relative to the printing medium in the fast scan direction.

Usually, a drive mechanism for moving the printing medium relative to the print head is controlled by a microcontroller or microprocessor, a programmable digital device such as a PAL, a PLA, a FPGA or similar although the skilled person will appreciate that anything controlled by software can also be controlled by dedicated hardware and that software is only one implementation strategy.

One general problem of page wide printing is the formation of artifacts caused by the digital nature of the image representation and the use of equally spaced dots. One source of artifacts can be errors in the placing of printed dots caused by a variety of manufacturing defects such as the location of the marker elements in the print head or systematic errors in the movement of the printing head relative to the printing medium. In particular, if one marking element is misplaced or its firing direction deviates from the intended direction, the resulting printing will show a defect which can run throughout the printing. Similarly, a systematic error in the way the printing medium is moved relative to the printing medium may result in defects which may be visible. For example, slip between the drive for the printing medium and the printing medium itself will introduce errors.

Such errors as described above may result in "banding" that is the distinct impression that the printing has been applied in a series of bands. The errors involved can be very small—the colour discrimination, resolution and pattern recognition of the human eye are so well developed that it takes remarkably little for errors to become visible.

To alleviate some of these errors it is known to alternate or vary the use of marker elements so as to spread errors throughout the printing so that at least some systematic errors will then be disguised. For example, one method often called "shingling" in which multiple passes are made with less than the complete number of marking elements firing at the same time. However, printing dictionaries refer to "shingling" as a method to compensate for creep in book-making. The inventors are not aware of any industrially accepted term for the printing method wherein no adjacent pixels on a raster line are printed by one and the same nozzle. Therefore, from here on and in what follows, the terms "mutually interstitial printing" or "interstitial mutually interspersed printing" are used. It is meant by these terms that an image to be printed is split up in a set of sub-images, each sub-image comprising printed parts and spaces, and wherein at least a part of the spaces in one printed sub-image form a location for the printed parts of another sub-image, and vice versa.

Another method of printing is known as "interlacing", e.g. as described in U.S. Pat. No. 4,198,642. The purpose of this type of printing is to increase the resolution of the printing device. That is, although the spacing between nozzles on the printing head along the slow scan direction is a certain distance X, the distance between printed dots in the slow scan direction is less than this distance. The relative movement between the printing medium and the printing head is indexed by a distance given by the distance X divided by an integer.

The methods described above often include multi-pass printing. That is that the print head passes over the printing medium in several "passes" in order to print a complete part of the image. Each printing pass only provides the printing of an incomplete image which consists of printed portions and unprinted portions distributed over the printing medium. The multi-passes fill in the parts of the printed image which are missing. The reason for the multi-passes can be that each colour separation of an image is printed in one pass, or that each individual monochromatic image which makes up a complete coloured image (e.g. three—CMY or four—CMYK) is printed by a series of passes.

Multi-pass printing is very common in ink jet printers using a scanning printhead for the fast scan movement and a paper advance for the slow scan movement. Multi-pass printing can have a dual purpose:

1. When the intrinsic resolution of the printhead is lower than the targeted printed image resolution, the printhead cannot print all pixels during one pass. The image is in that case written by "interlacing". This means that dot lines are printed along the direction of movement of the printing medium in between the dot lines printed during a previous pass.
2. Normally one nozzle is "responsible" for all pixels in one dot line along the fast scan direction. Due to drop misplacements, typical for each individual nozzle, banding will occur. By introducing "shingling" one nozzle will not print all pixels during one pass. During other passes, other nozzles will print pixels not yet printed in that particular dot line by the previous nozzle. Shingling is not used to write images with a higher resolution than the intrinsic head resolution. Shingling spreads the drop misplacement caused by deviating nozzles and paper transport inaccuracies.

When a digital printing press is using a page wide array of nozzles, generally only a movement in the direction of transport of the printing medium exists. In a basic layout the printing medium is just passing only once in front of the print head. Drop misplacement or non-functional nozzles will create a banded image. The single pass concept leaves no room for shingling.

In the European patent applications EP 00 204699 and EP 01 000701 owned by the present applicant, the page wide printing head can move along its nozzle array direction. In this way it is proposed to accomplish shingling by having two arrays positioned in a certain way to print a first pass when text & line art and images (mixed mode) are to be printed. After this pass the first array is shifted over a half nozzle pitch to the previous position where the nozzles of array 2 were writing during the first pass. In the same way array 2 is positioned where array 1 was writing during the first pass. The above system runs at the basic single pass printing speed. Because shingling requires multiple passes, the throughput of this system goes down in relation to the amount of shingling that is done. In a particular embodiment 2 times shingling was used and as a result the throughput went down with a factor of 2. With the same particular embodiment, the system uses 2 arrays of 360 dpi per colour. When using 2 such arrays in one line it is possible to use 2 times shingling or redundancy. The advantage is that shingling is obtained in one pass and that the throughput is unaffected. However, the use of 2 arrays instead of one doubles the cost.

For pure text & line art a single pass with two arrays shifted over a half nozzle pitch will always be faster than using one head to increase the resolution by interlacing in a second pass. A particular embodiment of this concept uses two 360 dpi arrays shifted over a half nozzle pitch to write 720 dpi.

When multiple passes are used, the overall speed of printing is reduced. There is a continuous requirement for improvements in printing methods and printers. In particular, there is a requirement to increase the efficiency of multi-pass printing while providing high quality.

It is an object of the present invention to provide a printing method and apparatus which can provide high resolution printing at high speed.

SUMMARY OF THE INVENTION

In one aspect of the present invention a printing method is provided for printing an image on a sheet printing medium using a page wide printing head and a transporting device which provides relative movement between the sheet printing media and a first print head, the method comprising, presenting a series of sheet printing media to the first print head for printing in sequence, printing with the first print head a first sub-image of at least one set of monochromatic mutually interstitially printed sub-images of a first image onto a first sheet of printing medium of the series in one pass, printing in succession a sub-image of an image on each remaining one of the series of sheet printing media followed by printing a further sub-image of the at least one set of monochromatic mutually interstitially printed sub-images of the first image onto the first sheet printing medium. The number of sub-images and the sequence of printing of the sub-images may be independently settable. The print head may be elongate having a longitudinal axis, and the print head may be moved along its longitudinal axis after a printing pass. There may be a plurality of print heads and different sub-images of an image are printed on different print heads. Alternatively, a different colour can be printed with each print head. The series of sheet printing media are stored on the transporting device during the printing process. Typically, the transporting device stores S+1 sheets of printing media where S is the number of sub-images to be printed to complete printing of the first image. The printing steps may be non-contact printing steps such as ink jet printing steps.

The present invention also provides an apparatus for images onto sheet printing media, comprising: a page-wide printing head; a transporting device which provides relative movement between the sheet printing media and the printing head, the transporting device also being for temporarily storing and presenting a series of sheet printing media to the printing head for printing in sequence; a print controller for controlling the printing of a first sub-image of at least one set of monochromatic mutually interstitially printed sub-images of a first image in one printing pass of a first sheet of printing medium of the series and for controlling in succession the printing of a sub-image of an image on each remaining one of the series of sheet printing media followed by printing a further sub-image of the at least one set of monochromatic mutually interstitially printed sub-images of the first image onto the first sheet printing medium. The printer controller may also have means for setting independently the number of sub-images and the sequence of printing of the sub-images. The print head may be elongate having a longitudinal axis, and further comprise means for moving the print head along its longitudinal axis after a printing pass. There may be a plurality of print heads and different sub-images of an image may be printed on different print heads. However, there are generally more passes of printing to complete an image on one sheet than there are printing heads. The plurality of print heads may print different colours. The transporting device is preferably adapted to store the series of sheet printing media. Generally, the transporting device stores S+1 sheets of printing media where S is the number of sub-images to be printed to complete printing of the first image. The printing apparatus may be included in an ink jet printer.

The present invention also includes a computer program product for executing any of the methods according to the invention when executed on a computing device associated with a printing head. A machine readable data storage device may be provided storing the computer program product. The computer program product may be transmitted over a local or wide area telecommunications network.

The present invention may also provide a control unit for a printer for printing images on printing media, the printer comprising a page-wide print head and a transport device for storing and transporting sheet printing media relative to the print head for printing, the control unit comprising, means for controlling the printing of a first sub-image of at least one set of monochromatic mutually interstitially printed sub-images of a first image in one pass of a first sheet printing medium of the series and for controlling in succession the printing of a sub-image of an image on each remaining one of the series of sheet printing media followed by printing a further sub-image of the at least one set of monochromatic mutually interstitially printed sub-images of the first image onto the first sheet printing medium.

Using embodiments of the present invention, it is possible to introduce mutual interstitial printing without loss of throughput and at lower cost by while still being able to use only one array. Interlacing can also be done with only one array (thus lowering the cost) but at a throughput that is I times lower ("I" being the amount of interlacing).

The methods and devices of the present invention are also applicable to bring a form of mixed mode printing described in European patent applications EP 00 204699 and EP 01 000701 back to single pass printing speed v. This form of printing may be described as a mixed resolution text and line art method of printing in which the text is printed at one resolution and graphics are printed at another, usually lower resolution. If the number of mutual interstitial printing passes is indicated by S, the conveyor means that transports the printing medium in front of the print head is moving at a speed that is S times higher than the original single pass printing speed v without mutual interstitial printing. With this type of printing all the marking elements are potentially used for printing each raster line (whether they do print depends on the image to be printed). Hence, there is no redundancy and a failing nozzle will be visible on a full density image as a non-printed dot each S dots along one raster line. The conveying means preferably has a path long enough to hold S+1 printing media or n(S+1) media with n being an integer which is 1 or greater. The conveying means can comprise a conveyor or any other suitable carrier e.g. a drum.

The dependent claims each define an independent embodiment of the present invention.

The present invention will now be described with reference to the following drawings.

DESCRIPTION OF ILLUSTRATIVE EMBODIMENTS

The present invention will be described with reference to certain embodiments and drawings but the present invention is not limited thereto but only by the claims. The present invention will be described with reference mainly to ink-jet printing but the present invention is not limited thereto. The term "printing" as used in this invention should be construed broadly. It relates to forming markings whether by ink or other materials or methods onto a printing substrate. Various printing methods which may be used with the present invention are described in the book "Principles of non-impact printing", J. L. Johnson, Palatino Press, Irvine, 1998, e.g. thermal transfer printing, thermal dye transfer printing, deflected ink jet printing, ion projection printing, field control printing, impulse ink jet printing, drop-on-demand ink jet printing, continuous ink jet printing. Non-contact printing methods are particularly preferred. However, the present invention is not limited thereto. Any form of printing including dots or droplets on a substrate is included within the scope of the present invention, e.g. piezoelectric printing heads may be used to print polymer materials as used and described by Plastic Logic (http://www.plasticlogic.com/) for the printing of thin film transistors. Hence, the term "printing" in accordance with the present invention not only includes marking with conventional staining inks but also the formation of printed structures or areas of different characteristics on a substrate. One example is the printing of water repellent or water attractive regions on a substrate in order to form an off-set printing plate by printing. Accordingly, the term "printing medium" or "printing substrate" should also be given a wide meaning including not only paper, transparent sheets, textiles but also flat plates or curved plates which may be included in or be part of a printing press. In addition the printing may be carried out at room temperature or at elevated temperature, e.g. to print a hot-melt adhesive the printing head may be heated above the melting temperature. Accordingly, the term "ink" should also be interpreted broadly including not only conventional inks but also solid materials such as polymers which may be printed in solution or by lowering their viscosity at high temperatures as well as materials which provide some characteristic to a printed substrate such as information defined by a structure on the surface of the printing substrate, water repellance, or binding molecules such as DNA which are spotted onto microarrays. As solvents both water and organic solvents may be used. Inks as used with the present invention may include a variety of additives such as antoxidants, pigments and cross-linking agents.

Figure 1A:
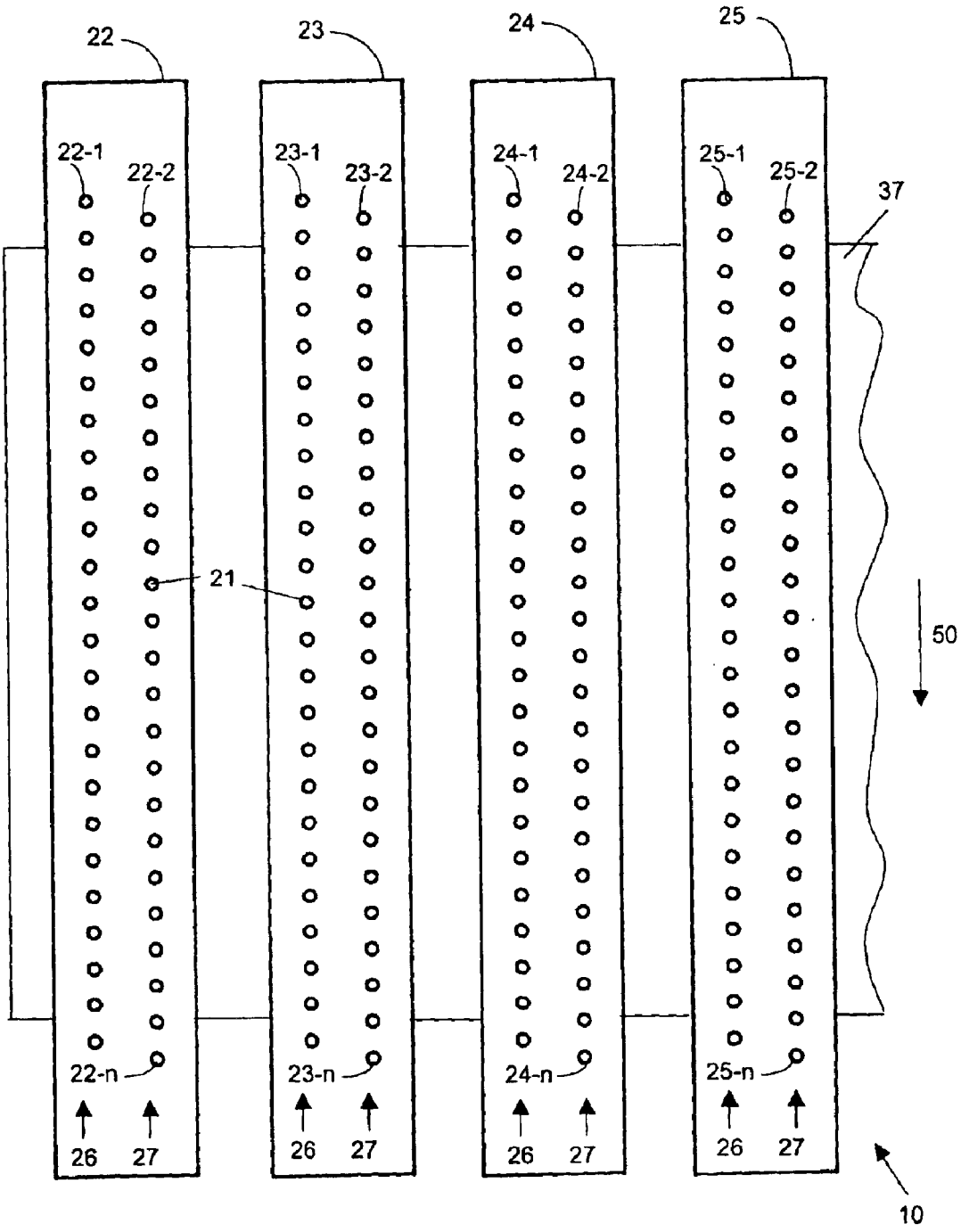
FIGS. 1A and B show schematically printing heads that may be used according to the present invention.

In accordance with an embodiment of the present invention a printing head may be a page-wide ink jet printing head 10 as shown in FIG. 1, for example as part of a printing machine 60. In FIG. 1A, the printing head 10 is elongate having a longitudinal axis 50 and a plurality of marking elements 21, for example a plurality of ink jetting orifices 22-1 . . . **22-*n*; 23-1 . . . 23-*n*; 24-1 . . . 24-*n*; 25-1 . . . 25-*n*** for the colours yellow, magenta, cyan, and black, respectively each arranged in an array 22, 23, 24, 25 respectively which may comprise two or more rows. In FIG. 1A there are two rows 26, 27 per colour whereby the second row is offset along the longitudinal direction of the head by a half a nozzle pitch compared with the first row.

Figure 1B:
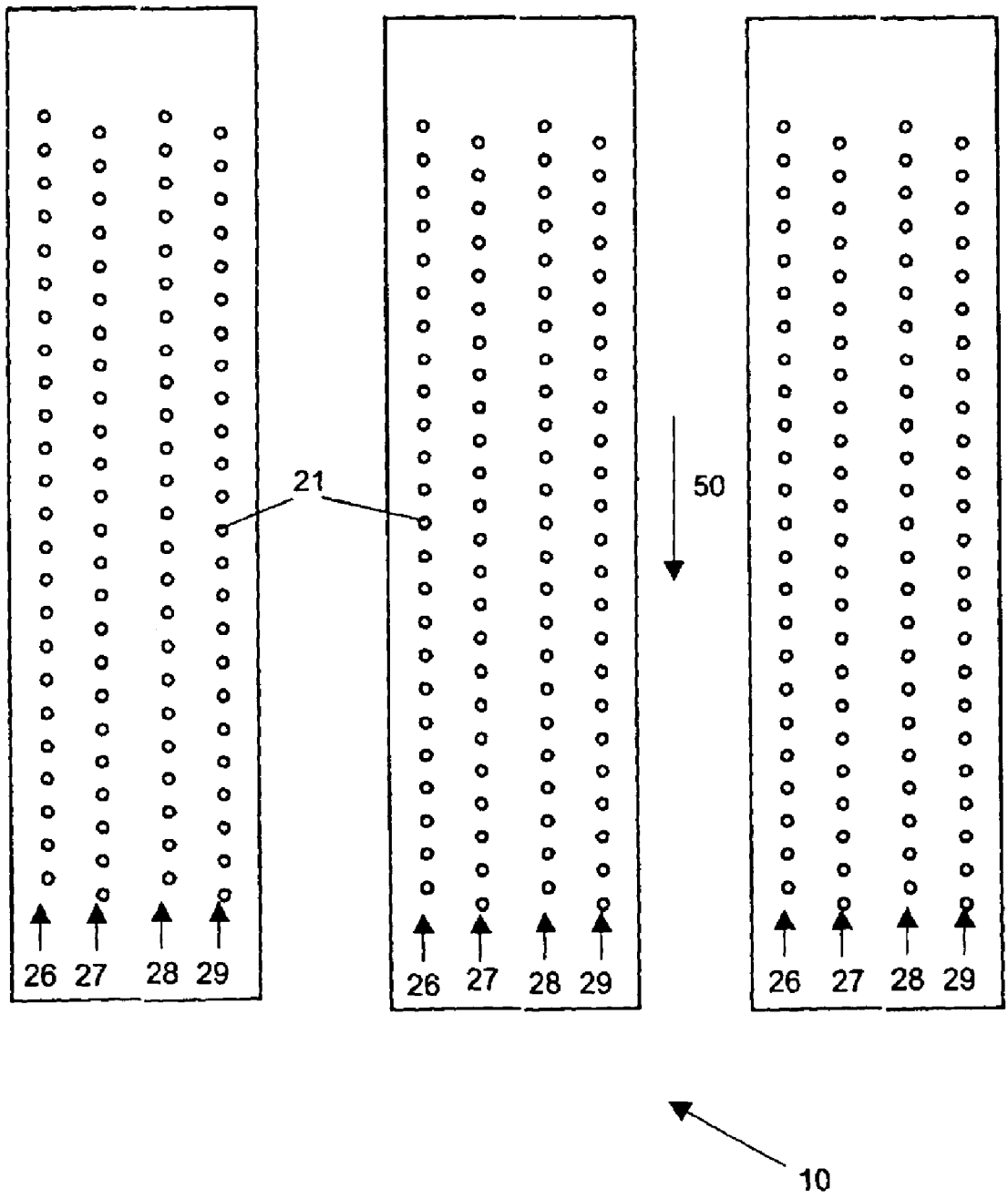

In FIG. 1B there are four rows 26, 27, 28, 29 per colour whereby the rows 26 and 28 are not offset with respect to each other and the rows 27 and 29 are each offset by a half of the nozzle pitch with respect to rows 26 and 28, respectively, in the direction parallel to the longitudinal axis 50 of the head 10. The printing head 10 of FIG. 1A or B extends across the width of a printing medium 37. Relative motion is provided between the printing medium 37 and the printing head 10 in a direction perpendicular to the longitudinal axis 50 of the printing head 10.

The operation of the present embodiment using a page wide printing head 10 as shown in FIG. 1A or 1B is as follows. As the printing is page wide, head 10 remains sensibly stationary for one pass of the printing medium relative to the printhead. To avoid that the same nozzle is used for the same dot position in each raster line, relative movement between the head 10 and the printing medium 37 in the direction parallel to the longitudinal axis 50 of the printing head 10 may be provided between passes so that the dots printed at a certain dot position in the raster lines are printed by different marking elements of the head 10. Alternatively, as can be understood from FIG. 1B, the change of marking elements between passes can be carried out by firing different rows 26, 27, 28, 29 of marking elements 21 rather than by movement of the head 10. That is the "movement" of the printhead is "virtual" and the physical movement of the head is replaced by transferring a firing pulse to another marking element. At each pass a part of a complete image is printed, that is a sub-image of the main image is printed. Typically, the whole of the printing medium will be printed in one pass with an image which is only a sub-image of the total image to be printed. This is also true at the monochromatic level, that is even for a monochromatic image only a part of the image is printed in one pass.

With page wide printing there is a need to prevent bad printing caused by a misaligned nozzle generating a line of bad or poor print. The printing head 10 is made at least as wide as the print medium (as shown in FIG. 1A). When only two rows 26, 27 of nozzles are provided as shown in FIG. 1A, the head can be made indexible in the cross-printing medium direction, that is parallel to the longitudinal axis 50 of the head 10. The index distance may be chosen as one or more nozzle pitches plus one pixel pitch (for instance, the pixel pitch can be chosen as half of a nozzle pitch). The head 10 may be wider than the printing medium thus providing a number of extra nozzles which go beyond the width of the printing medium. Thus, even if the head is moved in its longitudinal direction, enough marking elements cover the page width.

As an example of a printing step, in each raster line only 50% of the pixel positions in one image, e.g. monochromatic image, are printed in one pass of the printing medium through the printing machine 1. In subsequent printing passes of the printing medium through the printing machine 1 at least some of the missing pixel positions in each raster line are printed. If 50% of the complete image has been printed in the first pass then the printing can be completed in a second pass. More than two passes can be used. Methods of printing and apparatus therefor in which the same nozzle prints a line of dots down the printing medium as well as methods in which different nozzles printing the same pixel positions in a raster line between passes are included within the scope of the present invention.

Figure 2:
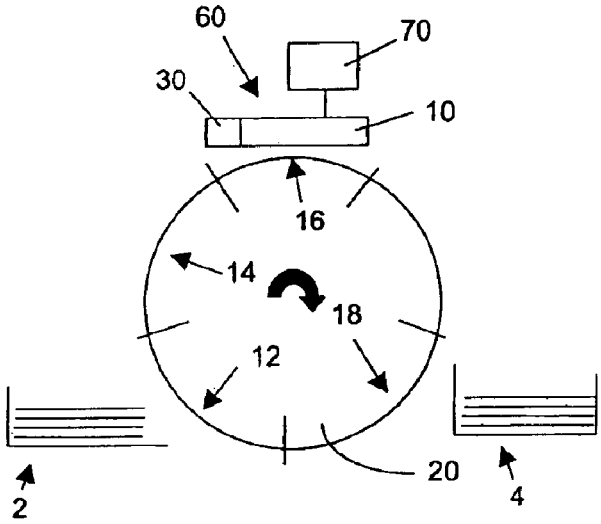
FIG. 2 illustrates a mutually interstitial or mutually interspersed printing device in accordance with an embodiment of the present invention.

Multi-pass printing is inefficient if the printing machine must wait in idle mode while the printing medium which has just been printed must be returned to the input side of the printing machine 60. FIG. 2 shows a schematic representation of an embodiment of a printing medium delivery mechanism which improves the efficiency of multi-pass printing with page-wide printing heads.

In FIG. 2 a printing medium conveyor means 20 is provided for receiving virgin printing media at location 12, for inputting printing media for printing by the print head 10 at position 14, for printing media at position 16 and for discharging completely printed media at position 18. The printing device also comprises the page wide printing head 10, an input means 2 for providing the virgin printing media, and an output means 4 for removing the printed media from the conveying means 20. The printing media will generally be in sheet-form, i.e. discrete pieces of flat material, e.g. pages of paper or plastic.

The conveyor means 20 conveys or transports the printing media between the positions 12, 14, 16, 18. The conveyor means 20 may be provided by any suitable means for transporting the relevant printing medium. For example, for paper or plastic sheets, a drum or conveyor can be used. Preferably, the conveyor means 20 has means for securing the printing media in repeatable and accurate positions on the conveyor means 20 so that the printing media always enter a printing process under the printing head 10 in exact registration. Alternatively or additionally, the conveyor means 20 may have a means for orienting the printing medium just before the beginning of printing using the printing head so that registration is maintained between printing passes. Means for maintaining registration between printing passes even with very large size printing media, e.g. A0, are known to the skilled person. Examples are:

a) during the first printing pass through the printhead, reference marks are applied to non-printed areas of the printing medium, e.g. along waste margins on either side of the printing medium. These printing reference marks may be at regular intervals along the edges of the printing media. The first pass of printing is carried out so that there is a specific and accurate and reproducable predetermined relationship between the raster lines to be printed and the reference marks. Mounted on the printing head 10 or separate from it, can be placed one or more sensors 30, for sensing the reference marks 32. The sensors may be optical sensors for instance. By using the marks as reference locations a printer controller 70 can control the printing positions of the raster lines on the printing medium so that a further pass of printing is carried out with the correct registration with respect to the existing printing on the printing medium. This can be achieved by controlling the timing of firing of the marking elements in the printing head 10 as well as the movement of the printing medium under the printing head. To co-ordinate these movements an encoder means may be associated with a drive mechanism of the printing medium, the encoder means, such as an optical encoder, provides an output, e.g. a series of pulses, whereby each pulse is associated with a certain distance moved by the printing medium. This outputs from the encoder means and the sensors 30 are supplied to the controller 70. A microprocessor or similar in the controller 70 can then output signals to the print head 10 in accordance with the signals received from the sensors 30 and the encoder means to control the printing operation.

b) The sensors 30 may sense other reference positions on a printing medium than those printed by the print head. For instance the sensors may sense the leading edge of a printing medium as well as the leading corners and from these reference locations the controller 70 may control the position of every printed pixel on the printing medium. Alternatively, the printing device may rely on the printing medium being in a sufficiently accurate position thanks to the way that each sheet of printing medium is loaded onto and held by the drum or conveyor. Then it is only necessary to provide an accurate relationship between the movement of the drum or conveyor and the firing pulses for the printhead. Such a relationship can be provided with any form of suitable encoder associated with the drum or conveyor and which provides signals, e.g. pulses, dependent upon movement of the drum or conveyor.

The conveying means provides suitable support to store the multiple sheets of printing medium which form the set of sheets which are travelling through the printing machine at any time. Generally, one image is printed on one side of the sheet media. Thus, sub-images of one image all printed on the same side of the sheet media. However, the present invention also includes duplex printing within its scope. However, then two images are printed one on each side.

Sheet input or output means 2, 4 may be any suitable device, e.g. a sheet feeding and aligning apparatus as described in U.S. Pat. No. 4,380,331 or similar. For instance, each sheet of printing medium may be delivered to and held on the conveying means by a device for clamping sheet-shaped recording material such as is described in U.S. Pat. No. 4,380,331 or similar.

In accordance with embodiments of the present invention it is possible to introduce mutual interstitial printing without loss (or with little loss) of throughput speed and at lower cost while still being able to use only one array of printing markers in the print head. Interlacing can also be done with only one array (thus lowering the cost) but at a throughput that is I times lower ("I" being the amount of interlacing). The present invention also includes the use of more than one printhead, in fact the number of printheads and the space on the conveying means 20 may be optimised with respect to throughput and device cost (caused by more printheads).

The methods and devices of the present invention are also applicable to bring mixed (line art and text) mode printing described in European patent applications EP 00 204699 and EP 01 000701 back to single pass printing speed v.

A printing method in accordance with an embodiment of the present invention allows the print head to print a reduced number of raster lines in one pass. It does this by skipping intermediate raster lines, e.g. it prints every second, third, fourth raster line, etc. The intermediate raster lines are then printed in subsequent print passes. Thus, in a first pass certain raster lines are printed over the printing medium, e.g. paper or plastic film, which do not complete the image. Instead they leave regular gaps or interstitial spaces in the printing. These gaps are filled in subsequent passes. Each subsequent printing pass creates a part of the printed image which is interleaved with previous parts—hence this form of printing is called mutually interstitial printing. Marker elements such as nozzles of an ink jet print head can print at a certain firing frequency. Thus there is a minimum time $t_f$ between subsequent firings of one marking element. If gaps are left in the printing then the print head must travel faster to reach the more distant printing position in the same minimum time $t_f$. If the number of mutual interstitial printing passes is S, each printing pass prints 1/S of the image—this means the distance between raster lines in one printed pass are S times further apart than the spacing of lines in the final printed image. Hence, the conveyor means that transports the printing medium in front of the print head moves at a speed that is S times higher than the original single pass printing speed v without mutual interstitial printing. With this type of printing all the marking elements are potentially used for printing each raster line (whether they do print depends on the image to be printed). This is called fast mutually interstitial printing. Hence, there is no redundancy and a failing nozzle will be visible on a full density image as a non-printed dot each S dots along one raster line. The conveying means preferably has a conveying path long enough to hold S+1 printing media or n(S+1) media with n being an integer which is 1 or greater. The conveying means can comprise a conveyor or any other suitable carrier e.g. a drum.

Figure 5:
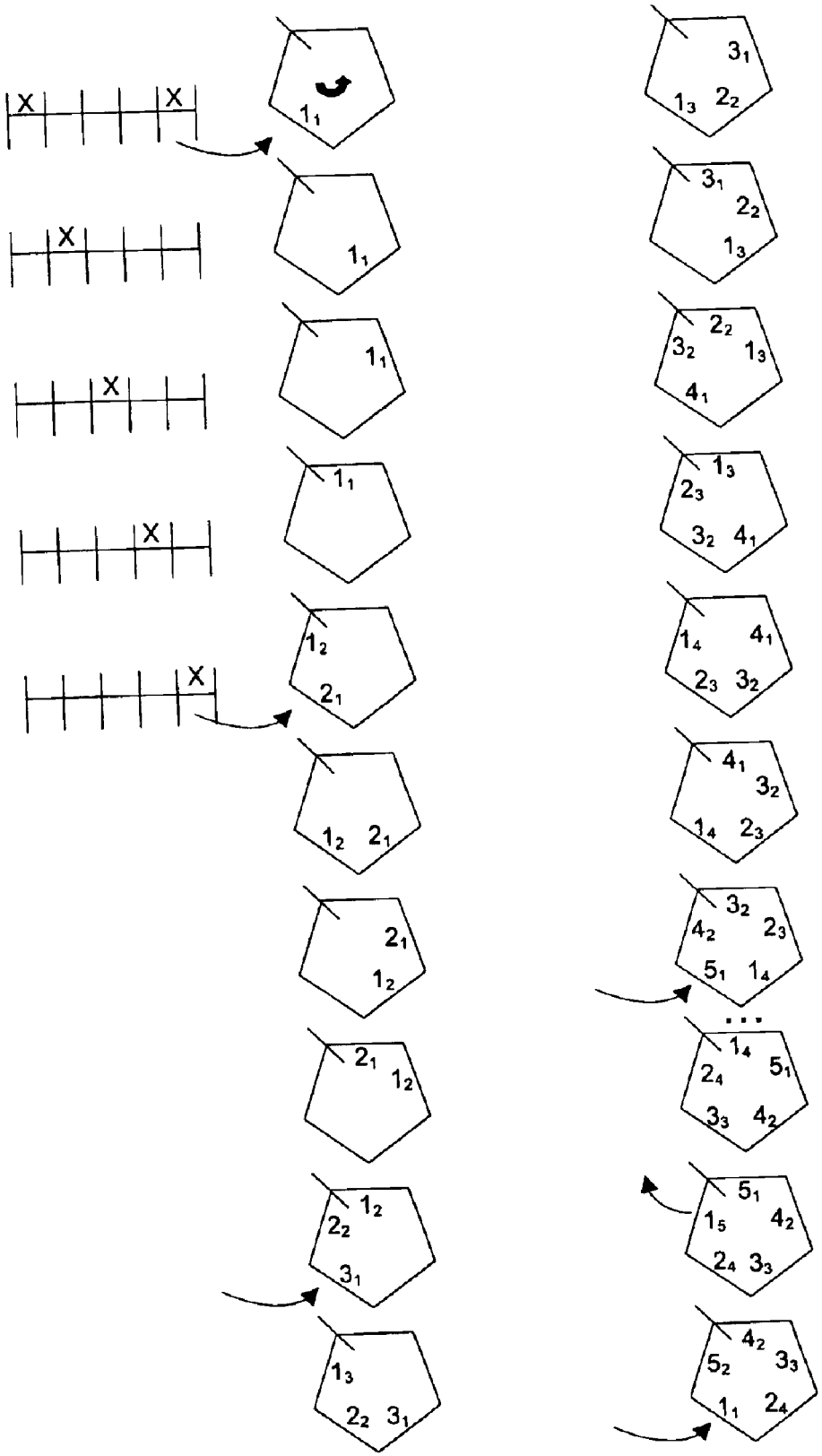
FIG. 5 is a schematic representation of sheet media being loaded onto a conveyor and printed in accordance with a method according to an embodiment of the present invention.

In accordance with one embodiment of a printing method of the present invention, when the conveying means can hold n(S+1) media the sequence below will have n papers labelled as paper 1-*n*. Paper 1 in its first pass will be described as $\mathbf{1}_1$ and so on up to $\mathbf{1}_s$. The sequence is as follows and is shown in FIG. 5 schematically for S is 4. In FIG. 5 the sequence starts at the top of the left hand column and goes down this column and restarts at the top of the next column. In FIG. 5 the conveyor is shown as a pentagonal cylinder but this is merely schematic in order to improve the clarity of the representation. The printing head is represented by a line at the 10 o'clock position. The feed-out position is the position immediately after the print position and the feed-in the position immediately after this position. The present invention includes alternative arrangements which achieve the same effect. The sequence is, then:

paper $\mathbf{1}_1$ is taken by the conveyor means at the paper feed-in position paper $\mathbf{1}_1$ is transported at speed S.v towards and under the page wide printing head to be printed through several paper locations when the trailing edge of paper $\mathbf{1}_1$ is printed after its first pass, the paper becomes $\mathbf{1}_2$ and the array of marking elements in the printing head is shifted over a number of nozzle pitches—when the paper position in front of paper $\mathbf{2}_1$ reaches the conveyor feed-in position, paper $\mathbf{2}_1$ is taken onto the conveyor, at that moment paper $\mathbf{1}_2$ is at the feed-out position (but paper $\mathbf{1}_2$ stays on the conveyor)

paper $\mathbf{2}_1$ will be printed next (to form $\mathbf{2}_2$), followed by paper $\mathbf{1}_2$ after the printing of paper $\mathbf{1}_2$, (to form $\mathbf{1}_3$) the head is shifted again over a number of nozzle pitches (e.g. back to the starting position is one possibility)

when the paper location on the conveyor next to paper $\mathbf{2}_2$ reaches the conveyor feed-in position, paper $\mathbf{3}_1$ is taken onto the conveyor. Paper $\mathbf{2}_2$ is at that moment at the feed-out position, but stays on the conveyor.

This sequence continues for S+1 papers. When paper S+1 is fetched, paper 1 is in its last pass (=Paper $\mathbf{1}^1{}_s$). Paper $\mathbf{1}_s$ is just in front of paper S+1 on the conveyor. Therefore, printing of the first pass of paper S+1 is done after the head has shifted. Paper 1 finally comes at the feed-out position and is taken away from the conveyor. The free position is at the feed-in position taken by a new paper, S+2. This implies, if S+1 is 5, that after fetching 5 papers during a start-up phase, always 5 papers are on the drum (except during the short time that a printed paper is being replaced by a new one). In FIG. 5 the conveyor is shown as a pentagonal cylinder but this is merely schematic in order to improve the clarity of the representation.

To compare the speed of a single pass system with this multipass system, two parts of the system are distinguished: the printing conveyor as described above and a feed-in conveyor.

In a single pass system the feed-in conveyor moves at a speed v, and the print conveyor takes over the papers with a speed v. In accordance with embodiments of the present invention the paper is transported at a speed S.v but with still the same amount of paper throughput as in the single pass system. Therefore, on the feed-in conveyor the papers can be separated S−1 paper distances from each other.

When the paper speed under the print head increases, the printed dots could become elongated or smeared. Typical single pass speeds for conventional printers are around 0.437 m/sec, resulting in the faster head speed of 1.75 m/sec for S=4. It is reasonable to consider S=4 in a system in accordance with the present invention. A higher number of passes is possible, but it is recommended to keep the paper speed below a certain speed, e.g. at or below 1.75 m/sec, but this depends on the state of the technology and may vary with time and with progress of control and printing technology. In case there are difficulties with high transport speeds, e.g. if S=8 is chosen and this causes a problem, it is preferred if not all fire pulses are used by each nozzle to print dots. For example, if only 50% of the fire pulses which could be applied to the array of nozzles, which could print a raster line, are actually allowed to fire, there is 50% redundancy. Throughput will go down by 50% but there will be a redundant nozzle for each nozzle which has to fire at a certain location on the printing medium. This may be of advantage if a nozzle becomes defective and the redundant nozzle is used instead. At this lower speed there are S+1=9 paper positions in the conveying means.

The present invention includes within its scope that the controller 40 can be programmed to allow the possibility to switch during a printing session or between printing sessions from e.g. S=4 to S=8 depending, for example, on the targeted print quality. According to the above case, a conveying means can be provided with 45 paper positions because 45 is the first number that can be divided by S+1=5 and S+1=9 (also for S=2 this would be suitable). The need for such a long conveyor can be avoided by varying the distance between the sheets. For example, a conveyor can be designed that allows for S=4 and n=2, 10 positions with a minimum distance x between the sheets. On use of S=8 the conveyor would contain 9 sheets with an increased distance in between them=x+(⅛) paper sheet length. In other words, at S=8 the printer would operate at 90% of the single pass throughput. In a similar way an operation at 90% of the single pass throughput can be obtained with S=2. For S=8, with the above assumption of limiting the paper transport speed, the above example would end up with a 45% throughput in comparison with the single pass.

Figure 3:
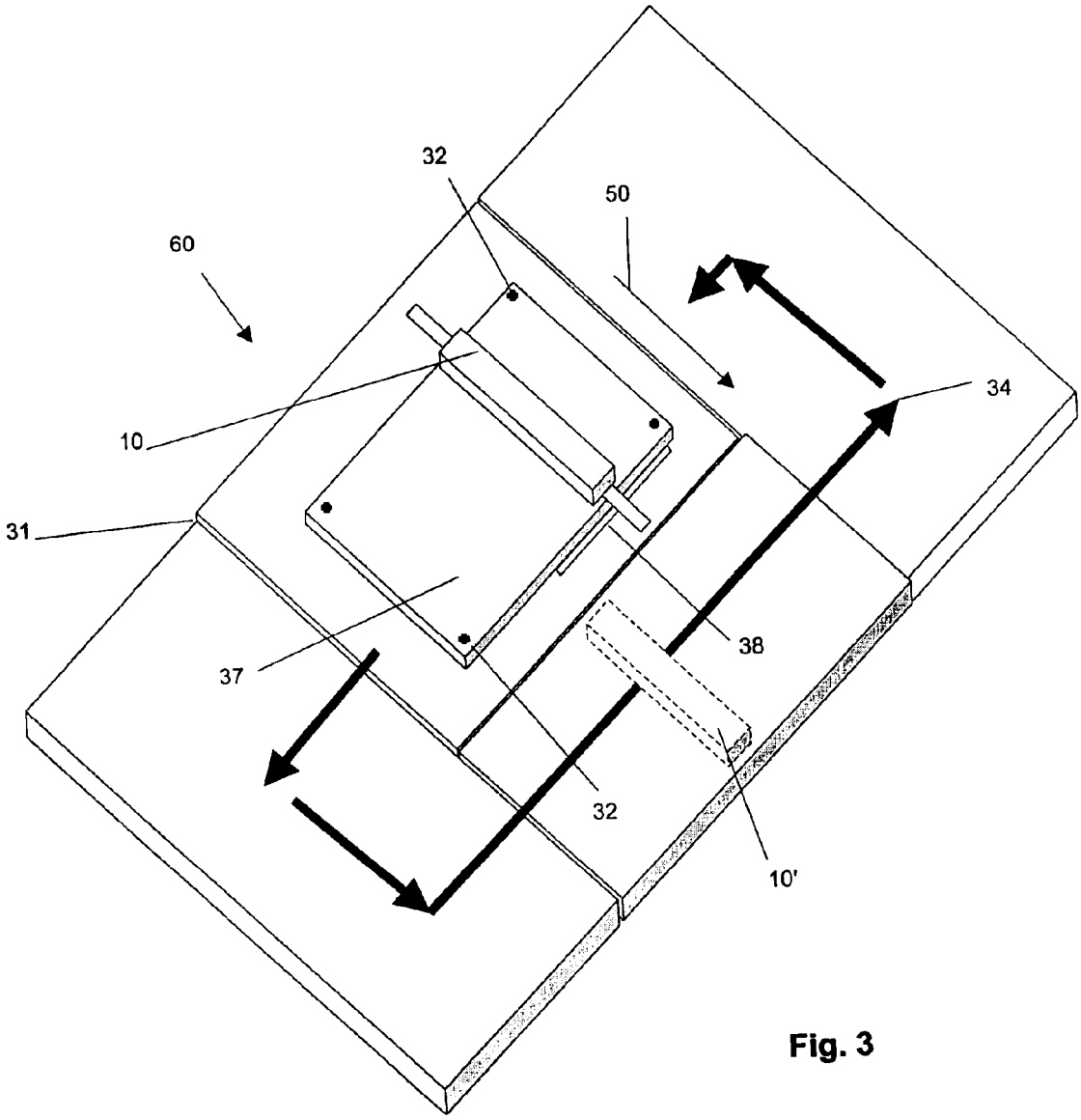
FIG. 3 is a highly schematic representation of an inkjet printer in accordance with an embodiment of the present invention.

FIG. 3 is a highly schematic general perspective view of a further inkjet printer 60 which an embodiment of the present invention. The printer 60 includes a base 31 and a page wide print head 10 that has a plurality of nozzles or similar marking elements. The print head 10 may also include one or more ink cartridges or any suitable ink supply system. A sheet of paper 37 or similar printing medium is fed over a support 38 by a conveyor mechanism (not shown). The conveyor mechanism conveys a sheet of paper or other printing medium 37 along a translatory path 34 to bring the sheet of printing medium 37 to the printhead 10 again in the same orientation. There is sufficient space and support along the path 34 to convey more than one sheet of printing medium at any time. That is, in general, there are several sheets of printing medium 37 traversing the path 34 at any time.

Figure 4:
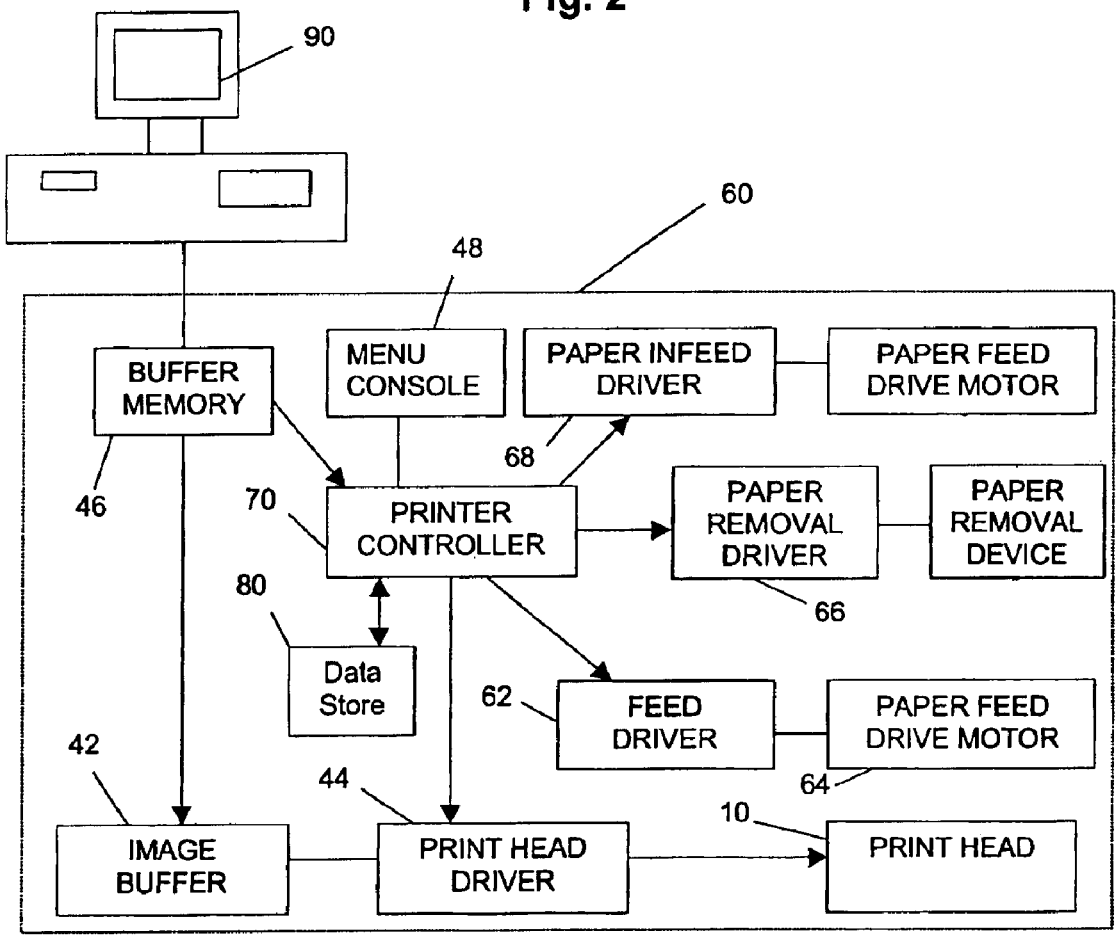
FIG. 4 is a schematic representation of a printer controller in accordance with an embodiment of the present invention.

FIG. 4 is a block diagram of the electronic control system of a printer 60, which is one example of a control system for use with a print head 10 in accordance with the present invention. The printer 60 includes a buffer memory 46 for receiving a print file in the form of signals from a host computer 90, an image buffer 42 for storing printing data, and a printer controller 70 that controls the overall operation of the printer 60. Connected to the printer controller 70 are a feed driver 62 for a paper feed drive motor 64 for driving the conveying mechanism of the paper, a paper infeed driver 68 for controlling a paper infeed device for introducing paper to the process flow, a paper removal driver 66 for controlling a paper removal device from removing paper from the process flow, a head driver 44 for the print head 10. In addition there is a data store 80 for storing parameters for controlling the interlaced and mutual interstitial printing operation in accordance with the present invention. Host computer 90 may be any suitable programmable computing device such as personal computer with a Pentium IV microprocessor supplied by Intel Corp. USA, for instance, with memory and a graphical interface such as Windows 2000 as supplied by Microsoft Corp. USA. The printer controller 70 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA.

The user of printer 60 can optionally set values into the data store 80 so as to modify the operation of the printer head 10. The user can for instance set values into the data store 80 by means of a menu console 48 on the printer 60. Alternatively, these parameters may be set into the data store 80 from host computer 90, e.g. by manual entry via a keyboard. For example, based on data specified and entered by the user, a printer driver (not shown) of the host computer 90 determines the various parameters that define the printing operations and transfers these to the printer controller 70 for writing into the data store 80. One aspect of the present invention is that the printer controller 70 controls the operation of printer head 10 in accordance with settable parameters stored in data store 80. Based on these parameters, the printer controller 70 reads the required information contained in the printing data stored in the buffer memory 46 and sends control signals to the drivers 44 and 62, 66, 68. In particular controller 70 is adapted for a dot matrix printer for printing an image on a printing medium, the control unit comprising, software or hardware means for controlling printing of the image as at least one set of monochromatic mutually interstitially printed sub-images, and software or hardware means for setting at least one of the number of sub-images and a sequence in which the printing of the sub-images is carried out, e.g. the sequences of printing passes to complete the printing of the image. At each pass a sub-image of the total image is printed. The controller may be used for independently setting the number of sub-images (i.e. passes) and the sequence of printing of the sub-images as well as to control the paper feed drive and he input and output devices for printing media. The controller is also adapted to control the operation of the printing head 10 so that each mutually interstitial printing step and/or each interlacing step is a pass of the printing head 10. As explained above the printing head has an array of marker elements under the control of the controller.

For instance, the printing data is broken down into the individual colour components to obtain image data in the form of a bit map for each colour component which is stored in the receive buffer memory 46. The sub-images are derived from this bit map, in particular each sub-image will start at a certain offset within the bit map. In accordance with control signals from the printer controller 70, the head driver 44 reads out the colour component image data from the image buffer memory 42 in accordance with a specified sequence of printing the sub-images and uses the data to drive the array(s) of nozzles on the print head 10 to mutually interstitially print the sub-images on different passes. The data which is stored in data store 80 may comprise:

a) the number of passes which will make up the interstitial printing operation, b) the redundancy of the mutual interstitial printing, that is the percentage of the active print nozzles which are used at each line printing operation, c) the offset in the bit map to be printed for each such pass.

The present invention includes the storing of alternative representations of this data which however amount to the same technique of printing. In each case a) to c) there can be a default value which is assumed to apply if the user does not enter any values. Also, in accordance with the present invention at least one of the parameters a) to c) is settable by the user. With respect to c), the sequence of offsets (and therefore the sequence of dealing with the sub-images) can, for instance, in one embodiment be freely specified by the user and there can be a default sequence if the user does not specify a sequence. This ability to set the sequence allows the user to choose the order in which the sub-images are printed. It will also be appreciated from the above that the user may freely set the number of sub-images to be printed by selecting one or more of the number of passes and the percentage redundancy. Hence, the user may select the complexity of the printing process which has an effect on the quality of print (e.g. lack of banding effects, masking defective nozzles) as well as the time to print (number of passes before the printing is complete).

The present invention also includes that items a) to c) above are machine settable, for instance printer controller 70 sets the parameters for printing, e.g. at least one of items a) to c) above, e.g. in accordance with an optimised algorithm. As indicated above the controller 70 may be programmable, e.g. it may include a microprocessor or an FPGA. In accordance with embodiments of the present invention a printer in accordance with the present invention may be programmed to provide different levels of printing complexity. For example, the basic model of the printer may provide selection of at least one of the number and sequence of printing of the sub-images. An upgrade in the form of a program to download into the microprocessor or FPGA of the controller 70 may provide additional selection functionality, e.g. the nozzle redundancy. Accordingly, the present invention includes a computer program product which provides the functionality of any of the methods according to the present invention when executed on a computing device. Further, the present invention includes a data carrier such as a CD-ROM or a diskette which stores the computer product in a machine readable form and which executes at least one of the methods of the invention when executed on a computing device. Nowadays, such software is often offered on the Internet or a company Intranet for download, hence the present invention includes transmitting the printing computer product according to the present invention over a local or wide area network. The computing device may include one of a microprocessor and an FPGA.

The data store 80 may comprise any suitable device for storing digital data as known to the skilled person, e.g. a register or set of registers, a memory device such as RAM, EPROM or solid state memory.

While the invention has been shown and described with reference to a preferred embodiment, it will be understood by those skilled in the art that various changes or modifications in form and detail may be made without departing from the scope of this invention. For instance, with reference to FIG. 4 the parameters for determining the combined mutual interstitial and interlaced printing are stored in data store 80. However, in accordance with the present invention the preparation for the printing file to carry out the above mentioned printed embodiments may be prepared by the host computer 90 and the printer 60 simply prints in accordance with this file as a slave device of the host computer 90. Hence, the present invention includes that the printing schemes of the present invention are implemented in software on a host computer and printed on a printer which carries out the instructions from the host computer without amendment. Accordingly, the present invention includes a computer program product which provides the functionality of any of the methods according to the present invention when executed on a computing device which is associated with a printing head, that is the printing head and the programmable computing device may be included with the printer or the programmable device may be a computer or computer system, e.g. a Local Area Network connected to a printer. The printer may be a network printer. Further, the present invention includes a data carrier such as a CD-ROM or a diskette which stores the computer product in a machine readable form and which can execute at least one of the methods of the invention when the program stored on the data carrier is executed on a computing device. The computing device may include a personal computer or a work station. Nowadays, such software is often offered on the Internet or a company Intranet for download, hence the present invention includes transmitting the printing computer product according to the present invention over a local or wide area network.

Further, in the above description only one print head has been described. However, a printing device in accordance with the present invention may have more than one printing head and the heads may be controlled by the printer controller to carry out methods according to the present invention. For instance as shown in dotted lines in FIG. 3, a further print head 10' may be provided at a different location. As shown the second print head 10' may print onto a first sheet a second sub-image of the image to be printed. For instance, print head 10 could print the odd passes and print head 10' the even passes. Generally, there will be more passes than print heads so that each print head must print multiple different sub-images of a single image to be printed on one sheet of printing medium. As the number of locations on the conveyor for storing sheets is S+1 where S is the number of passes of one print head, increasing the number of print heads reduces the number of locations required on the conveyor for the same total number of passes to complete one image on one sheet. Increasing the number of print heads increases the cost of the printing apparatus considerable, but reducing the conveyor size also reduces cost and makes the device more compact. Hence, the number of print heads able to print a printing pass, i.e. to print one sub-image of a monochromatic image on one side of the sheet, and the size of the conveyor may be optimised. Also, multiple print heads may also be provided to print multiple colours.

What is claimed is:

1. A printing method for printing an image on a sheet printing medium using a page wide printing head and a transporting device which provides relative movement between the sheet printing media and a first print head, the method comprising, presenting a series of sheet printing media to the first print head for printing in sequence, printing with the first print head a first sub-image of at least one set of monochromatic mutually interstitially printed sub-images of a first image onto a first sheet of printing medium of the series in one pass, printing in succession a sub-image of an image on each remaining one of the series of sheet printing media followed by printing a further sub-image of the at least one set of monochromatic mutually interstitially printed sub-images of the first image onto the first sheet printing medium.

2. The method according to claim 1, wherein the number of sub-images and the sequence of printing of the sub-images are independently settable.

3. The method according to claim 1, wherein the print head is elongate having a longitudinal axis, further comprising the step of moving the print head along its longitudinal axis after a printing pass.

4. The method according to claim 1 wherein there are a plurality of print heads and different sub-images of an image are printed by different print heads.

5. The method according to claim 1 wherein there are a plurality of print heads, further comprising the step of printing a different colour with each print head.

6. The method according to claim 1, further comprising storing the series of sheet printing media on the transporting device.

7. The method according to claim 6, wherein the transporting device stores S+1 sheets of printing media where S is the number of sub-images to be printed to complete printing of the first image.

8. The method according to claim 1 wherein the printing steps are non-contact printing steps.

9. The method according to claim 8, wherein the printing steps are ink jet printing steps.

* * * * *